US006866600B1

(12) United States Patent
Johnson

(10) Patent No.: US 6,866,600 B1
(45) Date of Patent: Mar. 15, 2005

(54) WIDE ANGLE ARROWHEAD

(76) Inventor: Gregory G. Johnson, 2025 Gateway Cir., Suite 1, Centerville, MN (US) 55038

( * ) Notice: Subject to any disclaimer, the term of this patent is extended or adjusted under 35 U.S.C. 154(b) by 123 days.

(21) Appl. No.: 10/603,755

(22) Filed: Jun. 25, 2003

(51) Int. Cl.[7] ..... F42B 6/08
(52) U.S. Cl. ..... 473/583; 473/584
(58) Field of Search ..... 473/583, 584

(56) References Cited

U.S. PATENT DOCUMENTS 5,192,081 A * 3/1993 Cooper
5,354,068 A * 10/1994 Maleski
5,417,440 A * 5/1995 Barrie et al.
5,494,298 A * 2/1996 Maleski
5,496,043 A * 3/1996 Ester
6,077,180 A * 6/2000 Adams

* cited by examiner

*Primary Examiner*—John A. Ricci
(74) *Attorney, Agent, or Firm*—Hugh D. Jaeger

(57) ABSTRACT

A wide angle arrowhead which is light weight, and which has minimal structure and surface area to decreased arrowhead weight, surface area and drag to increase performance of an arrow to which it is attached. A blade cutting edge of the wide angle arrowhead maintains an interior angle relationship to the centerline of an arrow shaft where such relationship can be fashioned to have one interior angular relationship within a specified angular range. Also, drag is minimized by the utilization of a thin ground blade cutting edge, an additional benefit of which is the decreasing of the cutting edge bluntness, thereby enhancing easy target penetration.

1 Claim, 7 Drawing Sheets

WIDE ANGLE ARROWHEAD

CROSS REFERENCES TO RELATED APPLICATIONS

None.

BACKGROUND OF THE INVENTION

FIELD OF THE INVENTION

The present invention relates to the field of archery, and more particularly, relates to an arrowhead having a wide angle.

DESCRIPTION OF THE PRIOR ART

Archers have long sought out an arrow which would outperform other arrows. Performance of an arrow is influenced by weight, component surface area, surfaces having parasitic drag, stabilization techniques, structure and other such considerations. One area of constant consideration and change is the arrowhead which is located at the front portion of an arrow. Often, the structure of an arrowhead is such that complex surfaces and devices composing the arrowhead are included, thereby not only adding weight to the arrow but also diminishing aerodynamic qualities of the arrowhead due to a multiplicity of drag causing surfaces. Such drag causing surfaces can be cutouts which beneficially lighten the weight of the arrow but which unwittingly create drag far more detrimental to flight than the benefit to flight derived by weight reduction. Of course, increased drag and increased weight are detrimental to suitable flight characteristics of an arrow, especially with respect to distance. Increased drag may also be found in a high penetration minimum profile narrow angle arrowhead which is elongated and has a narrow angle of leading edge cutting surface with respect to the centerline of the arrow shaft due to the abundance of surface area. Such an elongated arrowhead may also be of such weight as to be detrimental to the length of flight and trajectory of the arrow.

The present invention provides an arrowhead of minimum surface area and drag and of minimum weight to benefit the flight characteristics of an arrow.

SUMMARY OF THE INVENTION

The general purpose of the present invention is to provide an arrowhead, and more particularly, an arrowhead which is light weight and which has minimal structure and surface area.

According to one embodiment of the present invention, there is provided a wide angle arrowhead including suitable structure for mounting of a plurality of blades to a mounting fixture and suitable structure for mounting of the wide angle arrowhead to the forward portion of an arrow. The mounting fixture is a one-piece construction and includes a chisel point and a rearward facing circular recess for capture of the forward portion of one or more cutting blades, a first shaft portion extending from the circular recess against which the base edge at the lower portion of each blade aligns, an annular and slotted beveled ring juxtaposing the first shaft portion, the slots of which accommodate the base edges at the lower portions of the arrow blades, a second and larger slotted shaft portion, the slots of which are extensions of the slots in the annular and slotted beveled ring and which also accommodate the base edges at the lower portions of the arrow blades and a threaded shaft portion extending from the larger slotted shaft portion which is utilized to mount the mounting fixture and arrow blades, i.e., the entire wide angle arrowhead, to the arrow shaft. Each blade includes a blade capture protrusion at the rearwardly located trailing edge which is captured by a mounting ferrule. The blades are formed to have minimum structure and reduced drag surfaces and to have a low ratio of blade cutting edge length to blade trailing edge length where the interior angle between the blade cutting edge of the blades is at a relatively wide angle with respect to the centerline or longitudinal axis of the arrow shaft. Where many common arrowhead blades have a relationship where the interior angle of the blade cutting edge to the arrow shaft centerline angle is in the range of 10° to slightly less than 45°, the present invention has a blade cutting edge to arrow shaft centerline interior wide angle which can range from an interior wide angle of 45° to an interior wide angle of 75°. Also, drag is minimized by the utilization of a thin ground leading blade cutting edge, an additional benefit of which is the decreasing of the cutting edge bluntness, thereby enhancing easy target penetration.

One significant aspect and feature of the present invention is a wide angle arrowhead having a wide blade cutting edge to arrow shaft centerline interior angle.

Another significant aspect and feature of the present invention is an arrowhead which contributes to and improves flight characteristics of an arrow.

Yet another significant aspect and feature of the present invention is a wide angle arrowhead having minimal weight.

Still another significant aspect and feature of the present invention is a wide angle arrowhead having minimal drag.

A further significant aspect and feature of the present invention is a wide angle arrowhead utilizing a wide and thin ground leading blade cutting edge for drag reduction.

A still further significant aspect and feature of the present invention is a wide angle arrowhead having a low blade cutting edge to blade trailing edge ratio.

Having mentioned various aspects and features of the present invention, it is the principal object of the present invention to provide a wide angle arrowhead.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
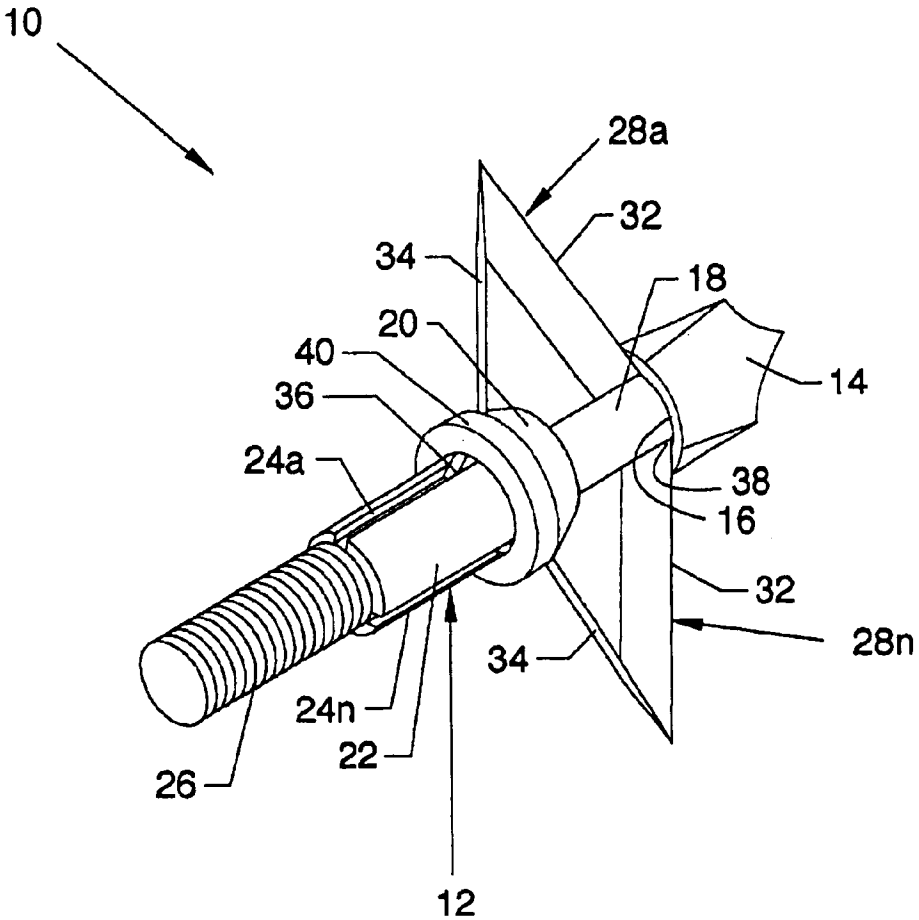
FIG. 1 is an isometric view of a wide angle arrowhead, the present invention.
Figure 2:
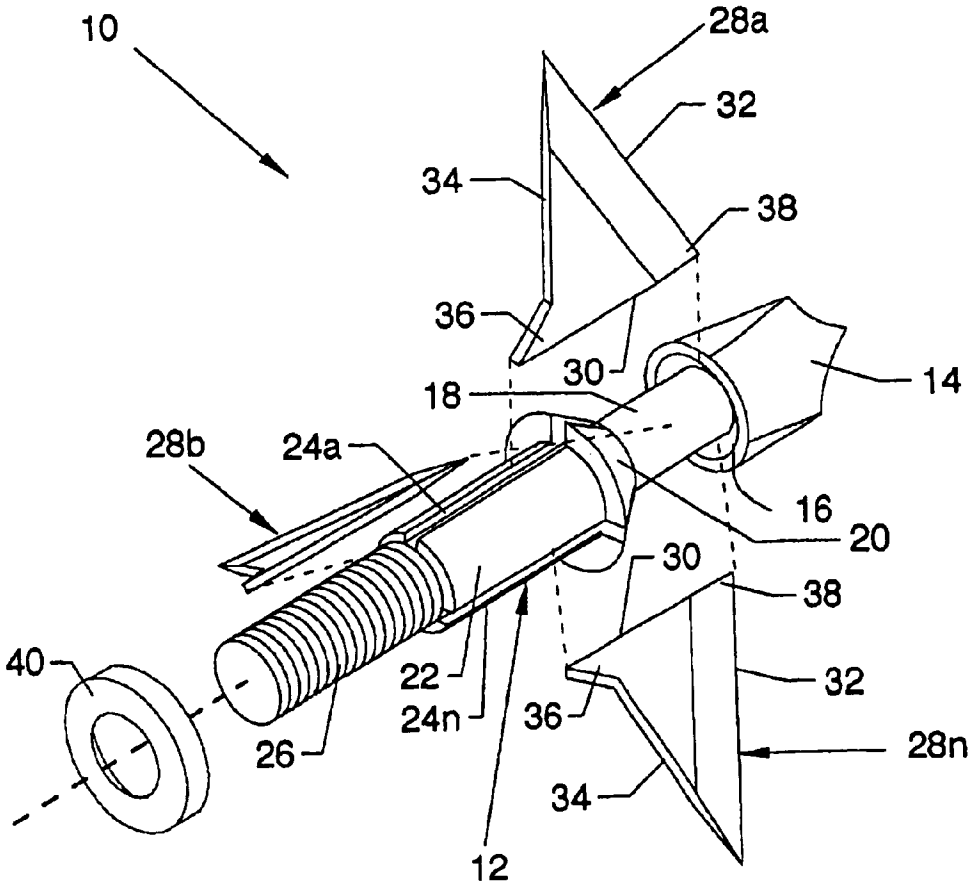
FIG. 2 is an exploded isometric view of the wide angle arrowhead.

FIG. 1 is an isometric view of a wide angle arrowhead 10, the present invention, and FIG. 2 is an exploded isometric view of the wide angle arrowhead 10. For purposes of example and illustration, the wide angle arrowhead 10 includes three blades, although different numbers of blades could be incorporated. With reference to FIGS. 1 and 2, the invention is now described starting generally at the forward portion of a mounting fixture 12. The mounting fixture 12, preferably a one-piece structure, forms the wide angle arrowhead 10 in part and accommodates other components comprising the instant invention. A chisel point 14 is located at the forward region of the mounting fixture 12. An angled rearwardly facing circular recess 16 is located at the junction of the rearward facing portion of the chisel point 14 and a first shaft portion 18 which is smooth and uninterrupted. A beveled ring 20, which is annular and which is slotted, is located adjacent to the first shaft portion 18 between the first shaft portion 18 and a second shaft portion 22. A plurality of slots 24*a*–24*n* extend continuously along and are recessed into the second shaft portion 22 and also extend continuously along and through the beveled ring 20 parallel to the centerline of the mounting fixture 12. The mounting fixture 12 also includes a threaded shaft portion 26 extending in a rearward direction from the beveled ring 20 for accommodation by the forward region of an arrow shaft (not shown).

A plurality of blades 28*a*–28*n* align and secure in the slots 24*a*–24*n*, respectively, which extend as previously described along the second shaft portion 22 and the beveled ring 20. Each blade 28*a*–28*n* has a blade base edge 30, a blade cutting edge 32, a blade trailing edge 34, a rearwardly located blade capture protrusion 36 which preferably is angled extending rearwardly from the junction of the blade trailing edge 34 and the blade base edge 30, and a forwardly placed blade capture point 38 being the apex of the blade base edge 30 and the blade cutting edge 32. The blade base edge 30 also aligns to the first shaft portion 18 and the blade capture point 38 aligns to and is captured by the inwardly beveled circular recess 16 at the rearwardly facing portion of the chisel point 14. The rearwardly located blade capture protrusion 36 of each blade 28*a*–28*n* extends into the slots 24*a*–24*n* and bridges the junction between the slots 24*a*–24*n* at the second shaft portion 22 and the rearward portion of the beveled ring 20 and is in intimate contact with a configured ferrule 40, preferably having an interior bevel 44 (FIG. 4) complementary to the blade capture protrusion 36. The ferrule 40 is forced against the blade capture protrusions 36 during attachment of an arrow shaft 42, as shown in FIG. 4.

Figure 3:
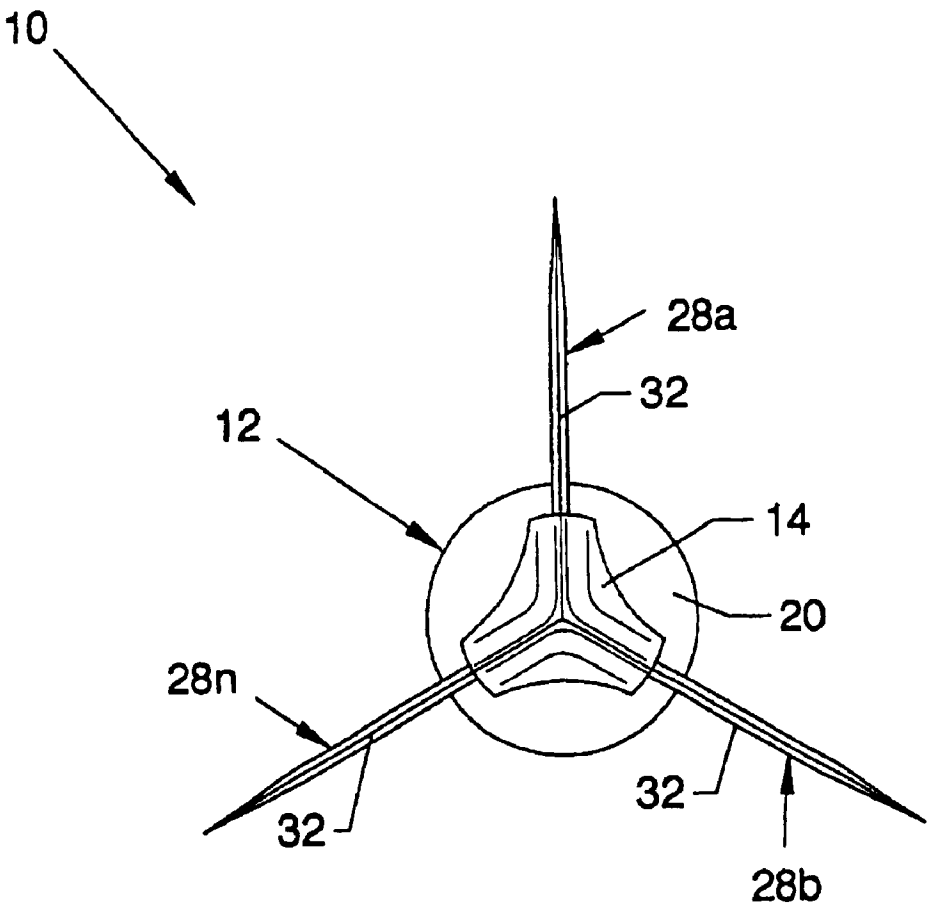
FIG. 3 is a front view of the wide angle arrowhead.

FIG. 3 is a front view of the wide angle arrowhead 10 illustrating the alignment of the blades about the centerline of the wide angle arrowhead 10.

Figure 4:
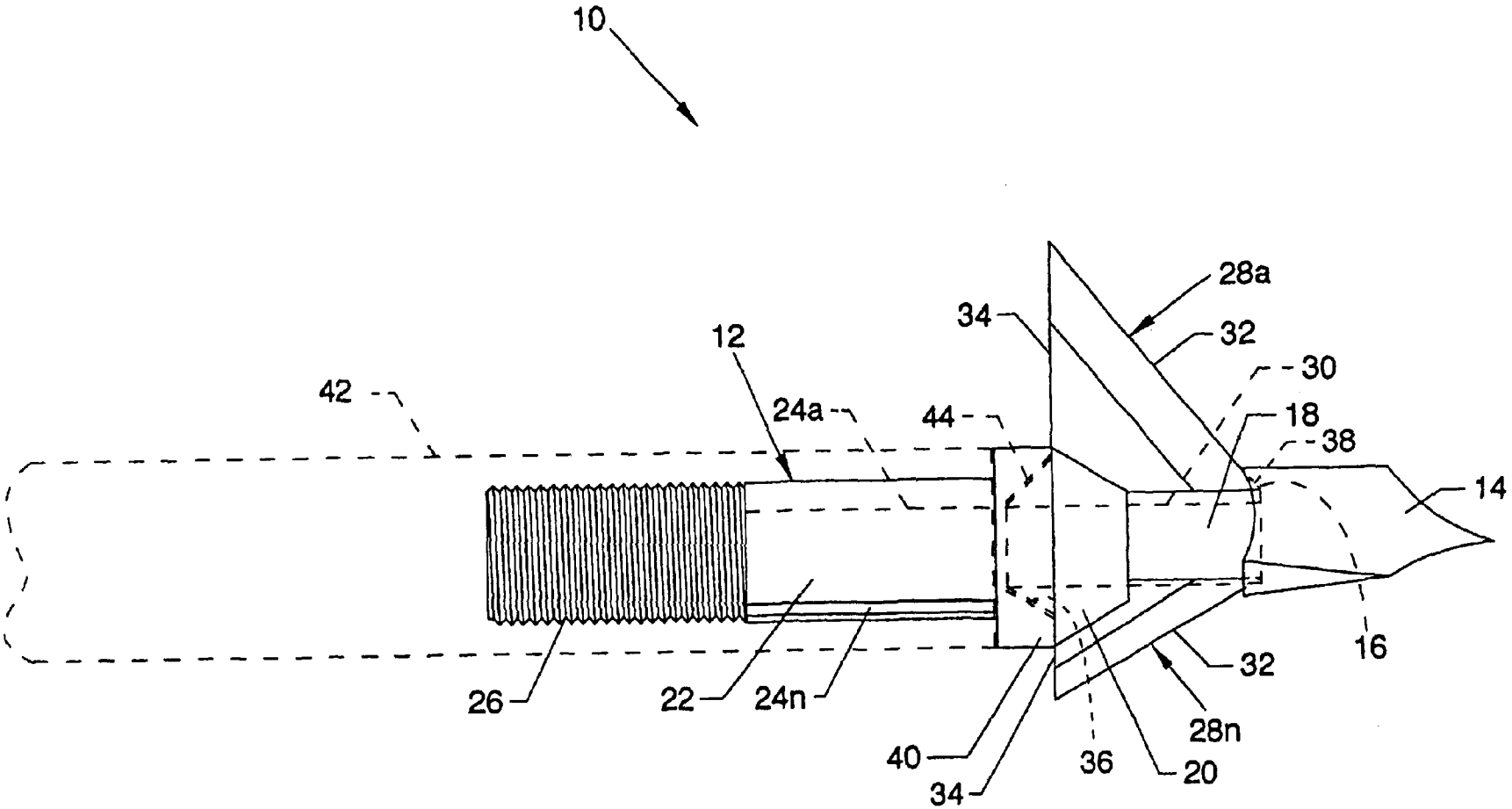
FIG. 4 is a side view of the wide angle arrowhead in use with and secured to an arrow shaft (shown in phantom) where the threaded shaft of the wide angle arrowhead engages the interior of the arrow shaft.

FIG. 4 is a side view of the wide angle arrowhead 10 in use with and secured to an arrow shaft 42 (shown in phantom) where the threaded shaft portion 26 of the wide angle arrowhead 10 engages the interior of the arrow shaft 42. Shown in particular is the capture of the blade 28*a* by forced engagement of the blade 28*a* into intimate contact with the circular recess 16 of the chisel point 14 and with the interior bevel 44 of the ferrule 40, such as described in relation to FIGS. 1 and 2. The capture of the blades 28*b* through 28*n* is accomplished in the same manner.

Figure 5:
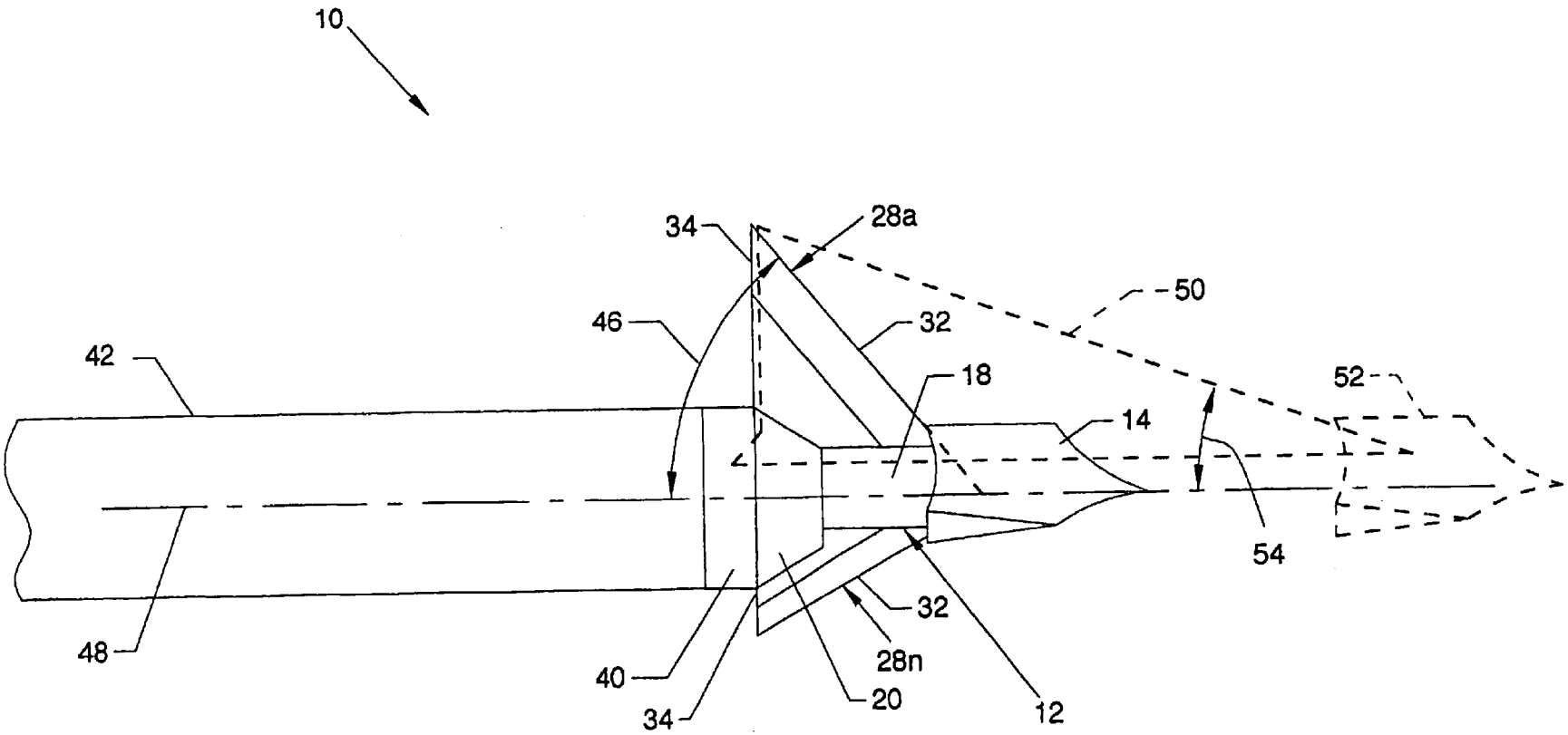
FIG. 5 illustrates the wide angle arrowhead and the angular relationship of the blade cutting edge to the centerline of the arrow shaft.

FIG. 5 illustrates the wide angle arrowhead 10 and the angular relationship of the blade cutting edge 32 to the centerline 48 of the arrow shaft 42. A wide angle 46, which is an interior angle, is shown between the blade cutting edge 32 and the centerline 48 and is illustrated as a 50° angle for purposes of example and illustration, but can be an angle included in a range as shown and described later in detail. Also, a dashed line representing the forward region of the blade cutting edge 32 is extended therefrom for added visual reference with respect to visualization of the wide angle 46 formed between the blade cutting edge 32 and the centerline 48 of the arrow shaft 42.

Additionally shown for comparison is a dashed outline of a narrow angle blade 50 and a dashed outline chisel point 52 in combination therewith and which could be attached to the arrow shaft 42 in a similar fashion superimposed over a wide angle blade 28*a* and chisel point 14 illustrating the blade area difference of the configuration of a wide angle arrowhead 10 using blade 28*a* with respect to a narrow angle blade 50. The narrow angle blade, such as blade 50, is a blade having an interior angle less than 45°, such as shown by interior angle 54. As can be seen in the illustration, the total surface area of the narrow angle blade 50 is significantly more than the total surface area of the wide angle blade 28*a*, whereby the extra surface creates extra drag where such drag is detrimental to efficient arrow flight. The use of wide angle blades, such as blade 28*a*, having less surface area and less drag enhances and improves flight characteristics of an arrow. The extra physical weight of the narrow angle blade 50 is also detrimental to efficient arrow flight. The use of wide angle blades, such as blade 28*a*, being of less weight than a narrow angle blade 50, enhances and improves flight characteristics of an arrow. The use of the narrow angle blade 50 also requires that the length of the first shaft portion 18 be longer than that required when using wide angle blades, such as blade 28*a*, and, accordingly, this is also detrimental to efficient arrow flight due to additional weight.

Figure 6:
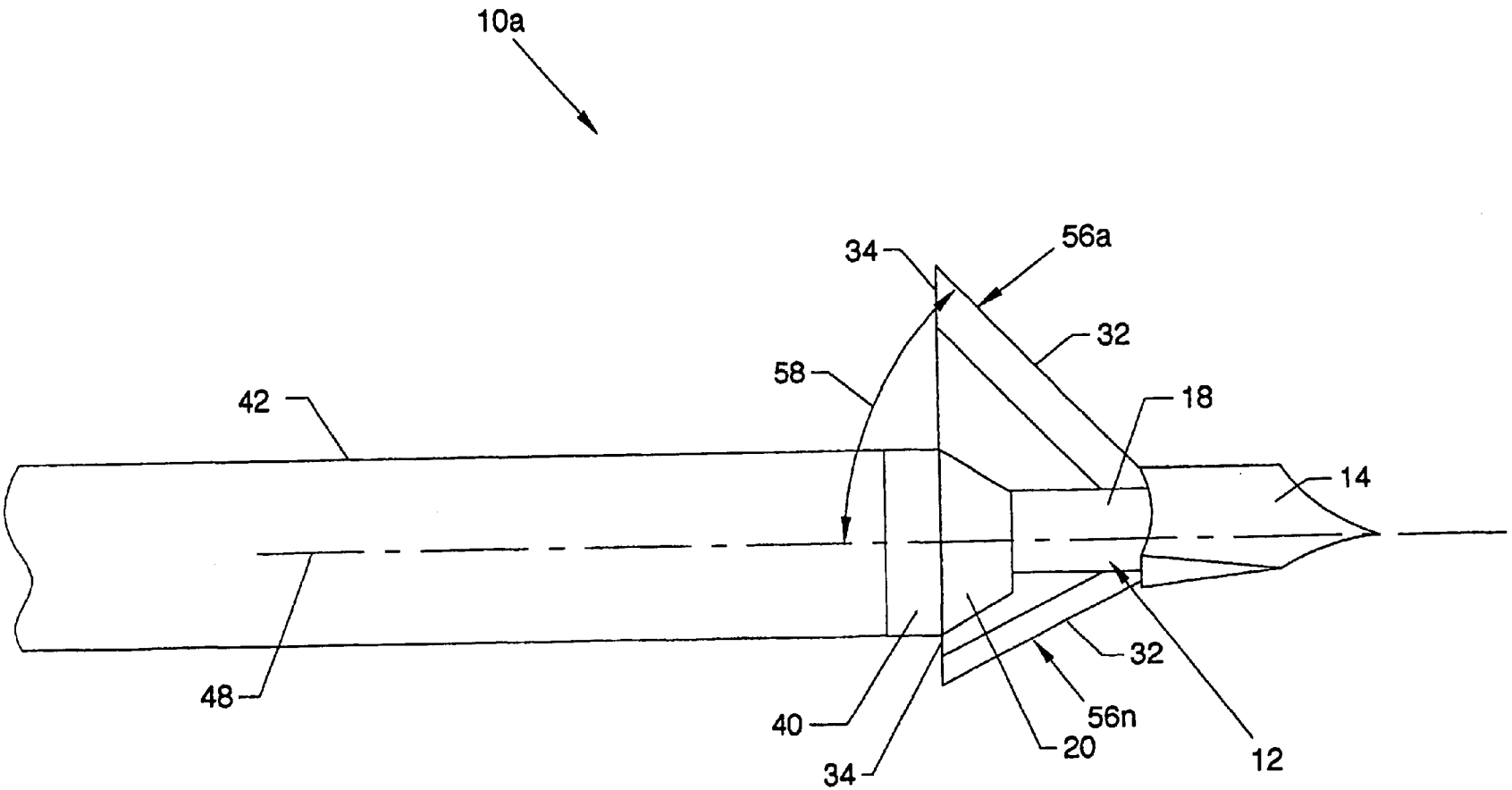
FIG. 6 is a side view of a wide angle arrowhead showing one angular limit end of the range of blade configurations; and, FIG. 7 is a side view of a wide angle arrowhead showing another angular limit end of the range of blade configurations.

FIG. 6 is a side view of a wide angle arrowhead 10*a* showing one angular limit end of the range of configurations of blades, where blades 28*a*–28*n* have been replaced by blades 56*a*–56*n* having the same enumerated feature nomenclature but where the blade cutting edge 32 of the wide angle blade 56*a* forms an interior wide angle 58 of 45°, a limit, between the blade cutting edge 32 and the centerline 48 of the arrow shaft 42.

Figure 7:
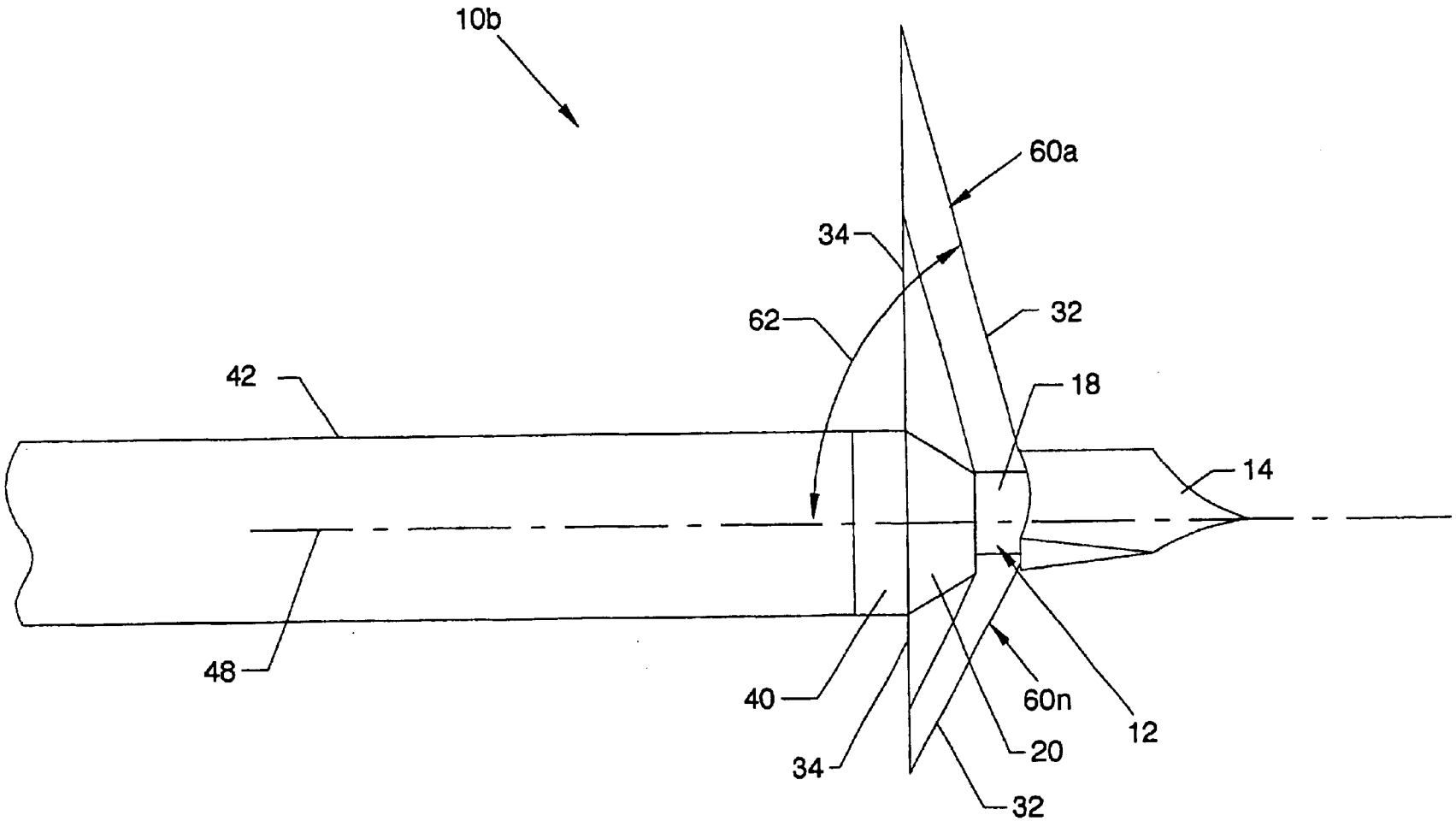

FIG. 7 is a side view of a wide angle arrowhead 10*b* showing another angular limit end of the range of configurations of blades, where blades 28*a*–28*n* have been replaced by blades 60*a*–60*n* having the same enumerated feature nomenclature but where the blade cutting edge 32 of the wide angle blade 60*a* forms an interior wide angle 62 of 75°, a limit, between the blade cutting edge 32 and the centerline 48 of the arrow shaft 42. As the interior wide angle increases, the length of the first shaft portion 18 may be decreased, thereby reducing weight further to increase arrow flight performance. FIGS. 6 and 7 illustrate a range of limits between the interior wide angle 58 of 45° and the interior wide angle 62 of 75°, respectively.

Various modifications can be made to the present invention without departing from the apparent scope thereof.

What is claimed is:

1. A wide angle arrowhead including suitable structure for mounting to the forward portion of an arrow shaft, comprising:

a. a plurality of cutting blades, each cutting blade formed to have minimum structure and low drag and including, (1) a leading edge including a cutting edge and a capture point;

(2) a trailing edge having a length which bears a low ratio to the length of the cutting edge of the leading edge; and, (3) a base edge having a capture protrusion extending rearwardly of the trailing edge;

b. a mounting fixture of one-piece construction and including, (1) a chisel point;

(2) a rearward facing circular recess capturing the capture points of the cutting blades;

(3) a first shaft portion extending from the circular recess against which the base edges of the cutting blades align;

(4) an annular beveled ring juxtaposing the first shaft portion, the annular beveled ring having slots, each slot accommodating a portion of the base edge of a cutting blade;

(5) a second shaft portion rearward of the annular beveled ring, the second shaft portion having slots which are extensions of the slots in the annular beveled ring and which also accommodate a portion of the base edge of a cutting blade; and, (6) a threaded shaft portion extending rearwardly from the second shaft portion for connection to the forward portion of an arrow shaft;

c. a mounting ferrule positioned about the second shaft portion of the mounting fixture and capturing the capture protrusions of the cutting blades; and, d. the cutting edge of each cutting blade forming a wide interior angle with respect to the centerline of the mounting fixture and, hence, also with respect to the centerline of an arrow shaft when the mounting fixture is connected to the forward portion of an arrow shaft.

* * * * *